US008272431B2

(12) United States Patent
Campagna et al.

(10) Patent No.: US 8,272,431 B2
(45) Date of Patent: Sep. 25, 2012

(54) HEAT EXCHANGER USING GRAPHITE FOAM

(75) Inventors: Michael Joseph Campagna, Chillicothe, IL (US); James John Callas, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 1425 days.

(21) Appl. No.: 11/896,396

(22) Filed: Aug. 31, 2007

(65) Prior Publication Data

US 2009/0126918 A1 May 21, 2009

Related U.S. Application Data

(63) Continuation-in-part of application No. 11/319,024, filed on Dec. 27, 2005, now Pat. No. 7,287,522.

(51) Int. Cl.
*F28F 13/12* (2006.01)

(52) U.S. Cl. ..... 165/180; 165/109.1; 165/133; 165/158; 165/907

(58) Field of Classification Search ..... 165/133, 165/158–159, 109.1, 180, 905, 907
See application file for complete search history.

(56) References Cited

U.S. PATENT DOCUMENTS

| | | | | |
|---|---|---|---|---|
| 3,265,124 | A * | 8/1966 | Reys | 165/133 |
| 4,119,141 | A * | 10/1978 | Thut et al. | 165/158 |
| 4,134,451 | A * | 1/1979 | Conant et al. | 165/133 |
| 4,222,434 | A * | 9/1980 | Clyde | 165/133 |
| 4,252,549 | A | 2/1981 | Chaunce et al. | |
| 4,279,293 | A | 7/1981 | Koump | |
| 4,310,747 | A | 1/1982 | Rice et al. | |
| 4,719,968 | A | 1/1988 | Speros | |
| 5,231,968 | A | 8/1993 | Siefkes | |
| 5,303,768 | A | 4/1994 | Alario et al. | |
| 5,896,896 | A | 4/1999 | Rojey | |
| 5,943,543 | A | 8/1999 | Uchida et al. | |
| 6,033,506 | A | 3/2000 | Klett | |
| 6,037,032 | A | 3/2000 | Klett et al. | |
| 6,142,222 | A | 11/2000 | Kang et al. | |
| 6,196,307 | B1 | 3/2001 | Ozmat | |
| 6,261,485 | B1 | 7/2001 | Klett | |
| 6,287,375 | B1 | 9/2001 | Klett | |

(Continued)

FOREIGN PATENT DOCUMENTS

EP 1 099 263 B1 4/2002

(Continued)

OTHER PUBLICATIONS

Haack et al., "Novel Lightweight Metal Foam Heat Exchangers," Porvair Fuel Cell Technology, Inc., Hendersonville, NC, pp. 1-7.

(Continued)

*Primary Examiner* — Leonard R Leo
(74) *Attorney, Agent, or Firm* — Finnegan, Henderson, Farabow, Garrett & Dunner LLP

(57) ABSTRACT

A heat exchanger is disclosed. The heat exchanger may have an inlet configured to receive a first fluid and an outlet configured to discharge the first fluid. The heat exchanger may further have at least one passageway configured to conduct the first fluid from the inlet to the outlet. The at least one passageway may be composed of a graphite foam and a layer of graphite material on the exterior of the graphite foam. The layer of graphite material may form at least a partial barrier between the first fluid and a second fluid external to the at least one passageway.

18 Claims, 2 Drawing Sheets

U.S. PATENT DOCUMENTS

| | | | |
|---|---|---|---|
| 6,344,159 | B1 | 2/2002 | Klett |
| 6,387,343 | B1 | 5/2002 | Klett |
| 6,398,994 | B1 | 6/2002 | Klett |
| 6,399,149 | B1 | 6/2002 | Klett et al. |
| 6,430,935 | B1 | 8/2002 | Klett et al. |
| 6,581,679 | B2 | 6/2003 | Fischer et al. |
| 6,656,443 | B2 | 12/2003 | Klett |
| 6,663,842 | B2 | 12/2003 | Klett |
| 6,673,328 | B1 | 1/2004 | Klett et al. |
| 6,729,269 | B2 | 5/2004 | Ott et al. |
| 6,763,671 | B1 | 7/2004 | Klett et al. |
| 6,780,505 | B1 | 8/2004 | Klett et al. |
| 6,809,304 | B2 | 10/2004 | Besmann et al. |
| 6,929,866 | B1 | 8/2005 | Williams et al. |
| 6,971,377 | B2 | 12/2005 | Moyer et al. |
| 6,976,530 | B2 | 12/2005 | Hayashi et al. |
| 6,994,154 | B2 | 2/2006 | Nagashima et al. |
| 7,017,655 | B2 | 3/2006 | Wilson et al. |
| 7,048,802 | B2 | 5/2006 | Kaeppeler et al. |
| 7,080,634 | B2 | 7/2006 | Yamashita |
| 7,086,457 | B2 | 8/2006 | Kienbock et al. |
| 7,131,288 | B2 | 11/2006 | Toonen et al. |
| 7,171,956 | B2 | 2/2007 | Igami et al. |
| 7,174,948 | B2 | 2/2007 | Schindler et al. |
| 7,225,862 | B2 | 6/2007 | Chin et al. |
| 2003/0000486 | A1 | 1/2003 | Ott et al. |
| 2003/0015184 | A1 | 1/2003 | Klipfel et al. |
| 2003/0168730 | A1 | 9/2003 | Davidson |
| 2003/0175201 | A1 | 9/2003 | Klett et al. |
| 2004/0123980 | A1 | 7/2004 | Queheillalt et al. |
| 2004/0221603 | A1 | 11/2004 | Arik et al. |
| 2005/0031504 | A1 | 2/2005 | Armstrong et al. |
| 2005/0230091 | A1 | 10/2005 | Brost et al. |
| 2006/0278377 | A1 | 12/2006 | Martins et al. |

FOREIGN PATENT DOCUMENTS

| | | | |
|---|---|---|---|
| FR | 2 704 277 | A | 10/1994 |
| FR | 2 856 747 | A | 12/2004 |
| JP | 52134153 | A | 11/1977 |
| JP | 60000294 | A | 1/1985 |
| JP | 60232496 | A | 11/1985 |
| WO | WO 98/04814 | A | 2/1998 |
| WO | WO 99/11586 | A | 3/1999 |

OTHER PUBLICATIONS

Rogers et al., "Preparation and Graphitization of High-Performance Carbon Foams From Coal," Touchstone Research Laboratory, Ltd.—CFOAM™ Group, The Millennium Centre, Triadelphia, WV, pp. 1-5.

Klett, Conway, Thermal Management Solutions Utilizing High Thermal Conductivity Graphite Foams; Carbon and Insulation Materials Technology Group, Metal and Ceramics Division, Oak Ridge National Laboratory, Oak Ridge, TN, 37831-6087; Performance Research, Inc., 3684 Delling Downs Road, Denver, NC 28037; pp. 1-11.

Butcher et al., Compact Heat Exchangers Incorporating Reticulated Metal Foam, Porvair Fuel Technology, http://www.porvairadvancedmaterials.com/documents/Heat%020Exchange.pdf, p. 1.

SAE International, Surface Vehicle Recommended Practice, 2003, pp. 1-11.

RFF, Finned Tube Bundle Heat Exchanger, Catalog 22, Young Touchstone, 2001, pp. 1-4.

http://www.ergaerospace.com/project_gallery.shtml, "Project Gallery," ERG Materials and Aerospace Corporation, Feb. 13, 2006, pp. 1-2.

http://www.smp-training.com/Counterman/TCDaC/HeatingSystems/Pages/heat20.html, Heater Systems & Components, TCD, Dec. 1, 2005, p. 1.

http://www.smp-training.com/Counterman/TCDaC/HeatingSystems/Pages/heat21.html, Heater Systems & Components, TCD, Aluminum Heater Cores, Dec. 1, 2005, p. 1.

Q. Yu et al., Carbon Foam—New Generation of Enhanced Surface Compact Recuperators for Gas Turbines, Proceedings of GT2005 ASME Turbo Expo 2005, Jun. 6-9, 2005, pp. 1-6.

Howard and Korinko, http://72.14.203.104/search?q=cache:XQNxkmA5AJQJ:sti.srs.gov/fulltext/ms2002424.pdf+foam+and+braze+or+brazing&hl=en&ie=UTF-8, Vacuum Furance Brazing Open Call Reticulated Foam to Stainless Steel Tubing, Dec. 1, 2005, pp. 1-10.

U.S. Appl. No. 11/319,024, filed Dec. 27, 2005, "Engine System Having Carbon Foam Exhaust Gas Heat Exchanger," pp. 1-20, Figs. 1-5.

U.S. Appl. No. 11/390,636, filed Mar. 28, 2006, "Method of Manufacturing Metallic Foam Based Heat Exchanger," pp. 1-25, Figs. 1-3.

U.S. Appl. No. 11/905,308, filed Sep. 28, 2007, "Heat Exchanger with Conduit Surrounded by Metal Foam," pp. 1-11, Figs. 1-3.

* cited by examiner

HEAT EXCHANGER USING GRAPHITE FOAM

RELATED APPLICATIONS

This application is a continuation-in-part of U.S. patent application Ser. No. 11/319,024, filed Dec. 27, 2005 now U.S. Pat. No. 7,287,522, the entire contents of which are incorporated herein by reference.

STATEMENT OF GOVERNMENT INTEREST

This invention was made with Government support under Contract No. DE-AC05-00OR22725 awarded by the Department of Energy. The Government may have certain rights in this invention.

TECHNICAL FIELD

The present disclosure relates generally to a heat exchanger and, more particularly, to a heat exchanger with passageways fabricated from graphite foam.

BACKGROUND

Machines, including for example, on-highway trucks, wheel loaders, and excavators, utilize a variety of heat exchangers during operation. These heat exchangers may be used to increase, decrease, or maintain the temperature of oil, coolant, exhaust gas, air, and other fluids used in various machine operations.

In general, heat exchangers are devices that transfer thermal energy between two fluids without direct contact between the two fluids. A primary fluid is typically directed through a fluid passageway of the heat exchanger while a secondary cooling or heating fluid is brought into external contact with the fluid passageway. In this manner, thermal energy may be transferred between the primary and secondary fluids through the walls of the fluid passageway. The ability of the heat exchanger to transfer thermal energy from the primary fluid to the secondary fluid depends on, amongst other things, the heat transfer surface area of the fluid passageway (and associated structures) and the thermal properties of the heat exchanger materials.

Governments, regulatory agencies, and customers are continually urging machine manufacturers to increase fuel economy, meet lower emission regulations, and provide greater power densities. Due to these demands, the pressure and temperature differentials across heat exchangers are increasing. As a result, machine manufacturers must develop new materials and/or methods for increasing the ability of heat exchangers to transfer heat.

One method for improving the ability of a heat exchanger to transfer heat is described in U.S. Pat. No. 4,719,968 (the '968 patent), issued to Speros on Jan. 19, 1988. In particular, the '968 patent discloses a heat exchanger unit comprising a particulate heat exchanging mass or pack that consists of relatively small, mechanically immobilized particles. The immobilized particles are compressively retained in an enclosure in heat transfer relationship to each other and to a fluid directed therethrough. Preferred materials for the particles are crystalline carbon, copper and aluminum. The pack may be in cylindrical form and may be contained within metal conduits or, for solar radiation, within a transparent or translucent enclosure. The annular space between the conduits (one conduit being internal to the second conduit) may be packed with graphite particles having a thermal diffusivity which is of comparable magnitude to that of the encasing metal tube. Such an arrangement further improves the rate of heat transfer through a counter-flow fluid passing through the annular space. Also, the heat exchanger mass provides a significantly larger area of heat transfer contact between the particles and the fluid passing through the mass, as well as a multiplicity of minute flow channels to direct the fluid into intimate contact with adjacent heat transfer particles.

Although the heat exchanger of the '968 patent may provide a large area of heat transfer contact between the particles and the fluid passing through the mass, it may still be suboptimal. For example, using mechanical pressure to thermally couple the conduit to the pack may result in high thermal resistance. Also, the materials of the conduit and the pack may have different thermal properties (e.g., thermal conductivity and/or coefficient of thermal expansion). The difference in the thermal properties may cause the conduit to expand at a higher rate than the pack, resulting in loosening, cracking, and/or further increases in thermal resistance. Finally, for high flow rates, a large pressure may be required to immobilize the particles between the inner and outer conduits, thus creating undesirable stresses in the heat exchanger materials.

The disclosed heat exchanger is directed to overcoming one or more of the problems set forth above.

SUMMARY OF THE INVENTION

In one aspect, the present disclosure is directed to a heat exchanger. The heat exchanger may include an inlet configured to receive a first fluid and an outlet configured to discharge the first fluid. The heat exchanger may further include at least one passageway configured to conduct the first fluid from the inlet to the outlet. The at least one passageway may be composed of a graphite foam and a layer of graphite material on the exterior of the graphite foam. The layer of graphite material may form at least a partial barrier between the first fluid and a second fluid external to the at least one passageway.

In another aspect, the present disclosure is directed to a method of transferring thermal energy. The method may include conducting a first fluid through at least one passageway composed of graphite foam. The method may further include at least partially separating the first fluid from a second fluid that is external to the at least one passageway using a layer of graphite material.

DETAILED DESCRIPTION

Figure 1:
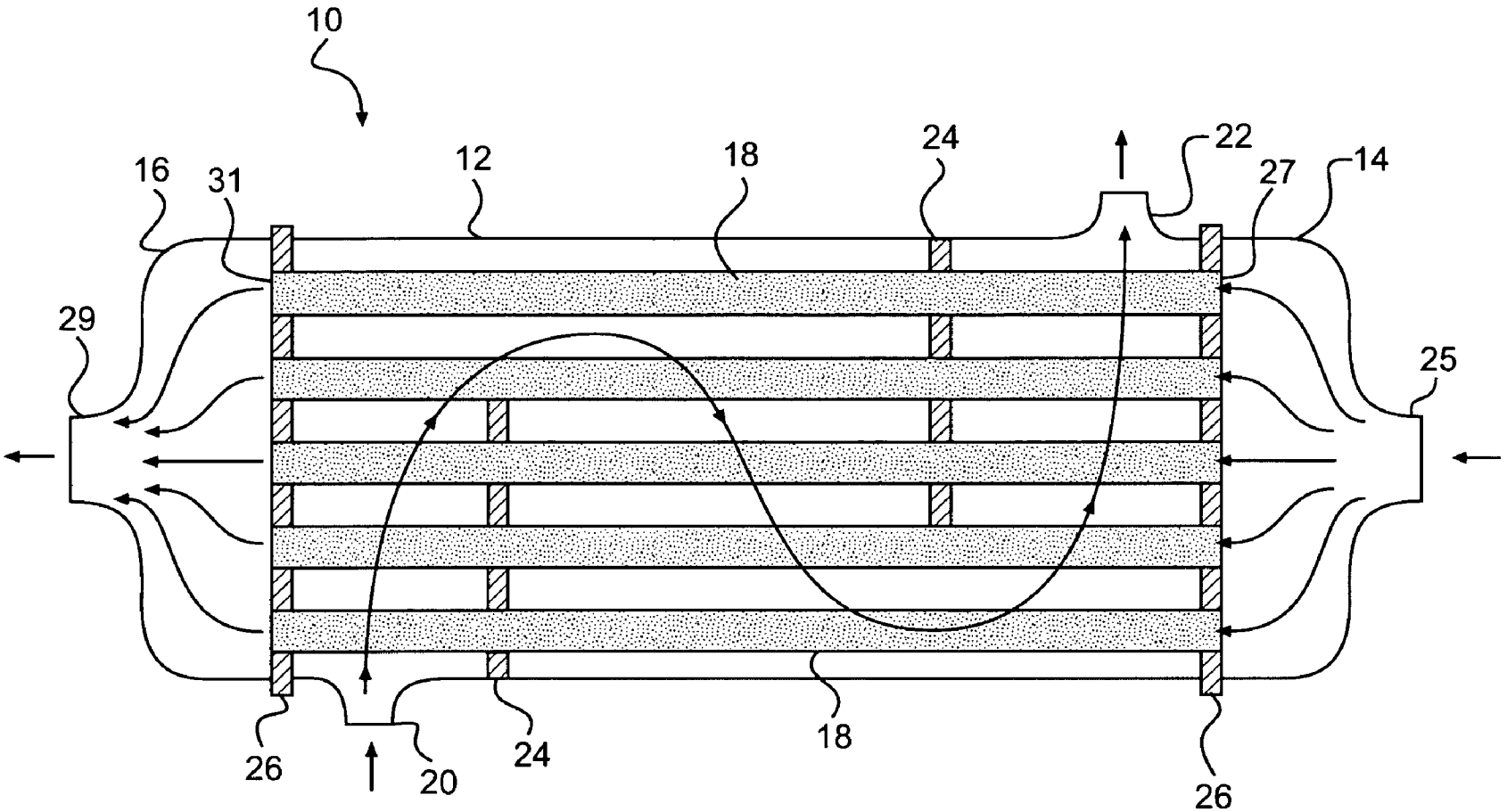
FIG. 1 is a cross-sectional illustration of an exemplary disclosed heat exchanger.

FIG. 1 illustrates a heat exchanger 10. Heat exchanger 10 may be a shell and tube-type heat exchanger or any other tube-type heat exchanger that facilitates transfer of thermal energy between two or more fluids. The fluids may include liquids, gasses, or any combination of liquids and gasses. For example, the fluids may include air, exhaust, oil, coolant, water, or any other fluid known in the art. Heat exchanger 10 may be used to transfer thermal energy in any type of fluid system, such as, for example, an exhaust and/or air cooling system, a radiator system, an oil cooling system, a condenser system, or any other type of fluid system. Heat exchanger 10 may include a housing 12, a first manifold 14, a second manifold 16, and one or more passageways 18 configured to conduct a first fluid.

Housing 12 may be a hollow member configured to conduct fluid across passageways 18. Specifically, housing 12 may have an inlet 20 configured to receive a second fluid and an outlet 22 configured to discharge the second fluid. Housing 12 may also have one or more baffles 24 located to redirect the second fluid. The redirection of the second fluid may help increase the transfer of heat by increasing the second fluid's interaction with passageways 18 (i.e., preventing a direct flow path from inlet 20 to outlet 22) and/or directing the second fluid to flow in a direction normal to an axial dimension of passageways 18 (i.e., creating a cross-flow configuration). It is contemplated that baffles 24 may also be omitted to create a parallel flow or counter flow configuration. Housing 12 may further include one or more passageway support members 26. Passageway support members 26 may embody plate-like members that include a plurality of holes configured to receive and support passageways 18. Passageway support members 26 may connect to passageways 18 via mechanical fastening, chemical boding, or in any other appropriate manner. It is contemplated that passageway support members 26 may be manufactured of metal, plastic, rubber, or any other material known in the art.

First and second manifolds 14 and 16 may be hollow members that distribute fluid to or gather fluid from passageways 18. First manifold 14 may have a first orifice 25, and a plurality of second orifices 27 fluidly connected to input ends of passageways 18. Second manifold 16 may have a plurality of second orifices 31 fluidly connected to output ends of passageways 18 and a first orifice 29. It is contemplated that first orifice 25 of first manifold 14 and/or first orifice 29 of second manifold 16 may be fluidly connected to a fluid system component (not shown), such as, for example, a filter, a pump, a nozzle, a power source, or any other fluid system component known in the art. It is contemplated that the first fluid may flow through heat exchanger 10 in either direction (i.e., the first fluid may enter first manifold 14 and exit second manifold 16 or enter second manifold 16 and exit first manifold 14).

Figure 2:
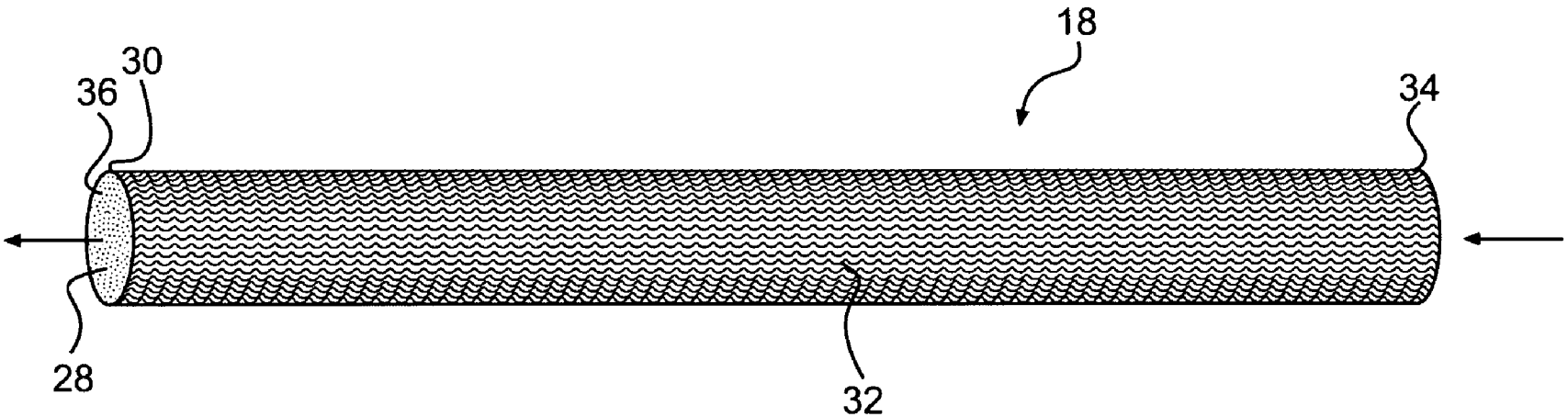
FIG. 2 is a pictorial illustration of a passageway used in the heat exchanger of FIG. 1.

Referring to FIG. 2, passageways 18 may be elongated members that conduct the first fluid through heat exchanger 10 and promote the transfer of thermal energy between the first and second fluids (the first fluid may be at either a higher or a lower temperature than the second fluid). Passageways 18 may include an inlet 34, an outlet 36, a separating layer 30, and one or more turbulators 32. It is contemplated that the materials used to manufacture passageways 18 may have appropriate structural and thermal properties (e.g., relatively high thermal conductivity, low coefficient of thermal expansion, and low density). Specifically, for example, passageways 18 may be composed of a carbon or a graphite foam 28. In one embodiment, passageways 18 may be substantially or entirely filled with foam 28.

Foam 28 may embody a network of connected ligaments composed of graphite. Foam 28 may be created using a coal and/or pitch precursor and may be manufactured using any appropriate method known in the art. A shape of each passageway 18 may be formed, for example, by creating foam 28 in a mold, by extruding foam 28, or by creating foam 28 in bulk and machining it to size. Foam 28 may also be heat treated. Foam 28 may be formed with an open cell structure that allows transmission of the first fluid through passageways 18 (i.e., fluid flows through the voids between the ligaments). It is contemplated that the percentage of void space in foam 28 may be modified to create a desired pressure and flow rate, a desired structural strength, and/or a heat transfer surface area required for a particular application of heat exchanger 10.

Layer 30 may be a structure that fluidly separates the first fluid from the second fluid. For example, layer 30 may embody a skin of solid graphite (i.e., a non-cellular structure) or a closed cell layer of foam 28. It is contemplated that layer 30 and foam 28 may be formed in a single manufacturing process (e.g., layer 30 and foam 28 created simultaneously) or may be formed in a series of processes (e.g., layer 30 created first and then foam 28 formed internal to layer 30, or vice versa). It is further contemplated that layer 30 may be manufactured to form only a partial barrier between the first and second fluids, thus allowing some mixing of the fluids. Layer 30 and foam 28 may be manufactured with strength properties (e.g., by modifying thickness of layer 30, size of foam ligaments, and/or width of passageway 18) such that each of passageways 18 provides its own structural support (i.e., passageway 18 does not require an additional exterior passageway for support). For example, it is contemplated that each of passageways 18 may support at least its own weight when supported at one or more locations along the length of each passageway 18.

Turbulators 32 may be turbulence promoting or enhancing structures located on an exterior surface of passageways 18. Turbulators 32 may comprise ridges, fins, angled strips, pins, or other types of protrusions or distortions configured to promote turbulence (and may additionally be configured to increase the available heat transfer surface area). Turbulators 32 may be attached to or embedded in layer 30. It is also contemplated that turbulators 32 may be integrally formed in layer 30 by, for example, creating turbulators 32 on an exterior surface of layer 30 or by creating turbulators 32 in an exterior surface of foam 28 before layer 30 is created on top of foam 28.

INDUSTRIAL APPLICABILITY

The disclosed heat exchanger may be implemented in any cooling or heating application where improved heat transfer capabilities are desired. The disclosed heat exchanger may use passageways composed of a high thermal conductivity graphite foam. The passageways of the disclosed heat exchanger may also have a layer of graphite or closed cell graphite foam that separates the second fluid flowing on the exterior of the passageways, from the first fluid flowing on the interior of the passageways. By using only graphite and/or graphite foam materials in the manufacturing of the passageways, the disclosed heat exchanger may achieve improved heat transfer and weight characteristics. The operation of heat exchanger 10 will now be explained.

Referring to FIG. 1, heat exchanger 10 may be utilized, for example, to cool a high temperature first gas flowing through passageways 18 using a lower temperature second gas flowing through housing 12. Initially, the lower temperature second gas may be received into housing 12 via inlet 20. The second gas may then be directed by baffles 24 to flow in a switchback-like pattern. The switchback-like pattern may increase the percentage of the total flow path where the second gas is flowing in a direction generally normal to the axial dimension of passageways 18.

While the second gas flows through housing 12, first manifold 14 may receive the higher temperature first gas and may distribute the first gas into the inlet ends of passageways 18. Upon entering passageways 18, the first gas may be conducted through the length of each of passageways 18 by flowing through the void spaces between the ligaments of foam 28. As the first gas flows through each of passageways 18, the thermal energy from the higher temperature first gas may be conducted through the ligaments of foam 28, through layer 30, and into the lower temperature second gas. As the thermal energy is transferred from the first gas to the second gas, the temperature of the first gas may decrease. Turbulators 32 located on the exterior surface of passageways 18 may enhance turbulence in the second gas as it flows across passageways 18. The turbulence of the second gas may improve the convective heat transfer between the first and second gases.

The disclosed heat exchanger may be implemented in any cooling or heating application where improved heat transfer capabilities are desired. The disclosed heat exchanger may use passageways comprised of a graphite foam and a layer of graphite or closed cell graphite foam. By using only graphite and/or graphite foam materials in the manufacturing of the passageways, the disclosed heat exchanger may achieve improved heat transfer and weight characteristics, while reducing thermal resistance and stress problems that may arise when using passageway materials with substantially different thermal conductivities and coefficients of thermal expansion. The network of ligaments in the graphite foam may also give the passageways structural rigidity without requiring other supporting structures or materials.

It will be apparent to those skilled in the art that various modifications and variations can be made to the disclosed heat exchanger. Other embodiments will be apparent to those skilled in the art from consideration of the specification and practice of the disclosed heat exchanger. It is intended that the specification and examples be considered as exemplary only, with a true scope being indicated by the following claims and their equivalents.

What is claimed is:

1. A heat exchanger, comprising:

an inlet configured to receive a first fluid;

an outlet configured to discharge the first fluid; and at least one passageway configured to conduct the first fluid from the inlet to the outlet, wherein the at least one passageway includes a graphite foam and a layer of graphite material on the exterior of the graphite foam, the layer of graphite material configured to form at least a partial barrier between the first fluid and a second fluid external to the at least one passageway, wherein the layer of graphite material includes a layer of closed cell graphite foam.

2. The heat exchanger of claim 1, wherein the graphite foam substantially fills the at least one passageway.

3. The heat exchanger of claim 1, wherein the layer of graphite material is configured to form a complete barrier between the first fluid and the second fluid external to the at least one passageway.

4. The heat exchanger of claim 1, wherein a plurality of turbulators are located on an exterior surface of the layer of graphite material.

5. The heat exchanger of claim 1, further including:

a housing;

a support member configured to support the at least one passageway within the housing;

a first manifold fluidly coupled to the inlet of the at least one passageway; and a second manifold fluidly coupled to the outlet of the at least one passageway.

6. The heat exchanger of claim 5, further including one or more baffles located within the housing.

7. The heat exchanger of claim 6, wherein the one or more baffles are configured to direct the second fluid in a flow direction generally normal to a flow direction of the first fluid.

8. The heat exchanger of claim 1, wherein the graphite foam and the layer of graphite material are configured to provide a structural support for the at least one passageway.

9. A method of transferring thermal energy, comprising:

conducting a first fluid through at least one passageway composed of graphite foam; and at least partially separating the first fluid from a second fluid that is external to the at least one passageway using a layer of graphite material, wherein the layer of graphite material includes a layer of closed cell graphite foam.

10. The method of claim 9, wherein the graphite foam substantially fills the at least one passageway.

11. The method of claim 9, wherein:

the first fluid is at a first temperature;

the second fluid is at second temperature different than the first temperature; and thermal energy is conducted between the first fluid and the second fluid via the graphite foam and the layer of graphite material.

12. The method of claim 9, further including a housing surrounding the at least one passageway, wherein the housing conducts the second fluid across the at least one passageway.

13. The method of claim 9, wherein the second fluid flows in a direction generally normal to a flow direction of the first fluid.

14. The method of claim 13, wherein the first fluid and second fluid are gasses.

15. The method of claim 9, further including creating turbulence in the second fluid as it flows across the layer of graphite material.

16. A heat exchanger, comprising:

a plurality of passageways composed of a graphite foam and a layer of closed cell graphite foam on the exterior of the graphite foam, the plurality of passageways being configured to conduct a first fluid;

a shell surrounding the plurality of passageways, wherein the shell is configured to conduct a second fluid across the plurality of passageways;

one or more baffles located within the shell; and a plurality of turbulators located on an exterior surface of the layer of closed cell graphite foam.

17. The heat exchanger of claim 16, wherein the graphite foam substantially fills the at least one passageway.

18. The heat exchanger of claim 16, wherein the graphite foam and the layer of closed cell graphite foam are formed in a single manufacturing process.

* * * * *